US005528971A

United States Patent [19]

Wood

[11] Patent Number: 5,528,971

[45] Date of Patent: Jun. 25, 1996

[54] MUSICAL INSTRUMENT HAVING A STABILIZATION APPARATUS

[76] Inventor: Mark W. Wood, 55 Mill Pond Rd., Port Washington, N.Y. 11050

[21] Appl. No.: 398,507

[22] Filed: Mar. 3, 1995

[51] Int. Cl.[6] ..... G10D 3/00

[52] U.S. Cl. ..... 84/327; 84/275; 84/280; 84/291

[58] Field of Search ..... 84/275, 278, 280, 84/291, 327

[56] References Cited

U.S. PATENT DOCUMENTS 3,955,461 5/1976 Ivie ..... 84/327

4,913,027 4/1990 Twohy ..... 84/280

*Primary Examiner*—Patrick J. Stanzione

*Attorney, Agent, or Firm*—Staas & Halsey

[57] ABSTRACT

A musical instrument having a stabilization apparatus wherein a body of the instrument is V-shaped to allow the neck of a musician to be placed within an opening formed in the body. A curve of one wing of the body fits around the back of the neck of the musician while a second wing has a tip which rests against the chest of the musician. A strap is connected to portions of each of the wings. Further, a telescopic mechanism is fixed to the back of the musical instrument at one end. Another end of the telescopic mechanism has a plate which rests on the chest of the musician to support the instrument in a fixed position.

23 Claims, 5 Drawing Sheets

MUSICAL INSTRUMENT HAVING A STABILIZATION APPARATUS

BACKGROUND OF THE INVENTION

1. Field of the Invention

The present invention relates to a musical instrument having a stabilization apparatus and, more particularly, to a stringed musical instrument, such as an electric violin, having a stabilization apparatus to enable the musical instrument to support itself against a musician's body.

2. Description of the Related Art

Musical instruments of the type having a body, a fretted neck and strings, e.g., violins and electric violins, require the support of portions of a musician's body to be played properly. The instrument is supported at one end by the musician's hand gripping the neck and at the other end by the musician's chin resting against the chin rest on the top of the instrument and the musician's shoulder supporting a shoulder rest on the bottom of the instrument. Such an instrument requires the use of one hand to support the neck and for the musician's neck to be bent at an angle to support the instrument between the musician's chin and shoulder. This traditional stringed instrument, by requiring one hand of the musician to support the neck and the musician's neck to be bent at a particular angle, is suitable for a stationary musician, but limits the movement of the musician while playing the instrument. Further, by requiring the neck of the musician to be bent at a particular angle while applying pressure on the chin rest of the instrument, fatigue begins to set in at the neck of the musician during extended play of the instrument. Also, while the musician is not playing the instrument, the left hand of the musician must support the neck of the instrument, otherwise, the instrument will fall to the ground. This traditional instrument, therefore, limits the use to only one hand of the musician for other purposes, such as playing another instrument like a piano. Movement by the musician is also restricted while the instrument is being played.

Other instruments have been designed to provide improved support of the traditional instrument having a single chin rest and shoulder rest at one end and a neck which is supported by the musician's hand at the other end. For example, U.S. Pat. No. 3,136,197 issued to Bried shows a violin having a neck strap affixed to one end of the violin. The neck strap is fastened around the neck of the musician and may be used in addition to or instead of a chin rest. This type of instrument requires the use of one of the musician's hands to support the neck of the violin, or else the violin will fall against and be parallel to the body of the musician. Also, this type of violin is free to rotate about the attachment point of the neck strap and the violin such that only limited support is provided in maintaining the violin in a fixed position. Still further, the violin of Bried can only practically be played when the body of the violin is substantially parallel to the ground, which makes the playing of the violin somewhat difficult.

U.S. Pat. No. 4,765,219 issued to Alm, shows an electric violin having a U-shaped neck ring affixed to one end of the electric violin. The neck ring is placed around the neck of the musician to support one end of the instrument. Again, however, to some extent, one hand of the musician is required to support the electric violin at its neck. Also, the electric violin is free to rotate about the musician's neck, thereby limiting the effect of stabilizing the electric violin at a fixed position.

Other examples of conventional musical stringed instruments with some sort of attachment which functions to contact the musician's chin, neck, shoulders or torso are U.S. Pat. No. 3,955,461 issued to Ivie, U.S. Des. Pat. No. 249,295 issued to Pinkins, Jr., and U.S. Des. Pat. No. 338,222 issued to Steinberger. These other examples of musical instruments having supports require the use of one hand at the neck of the instrument to partially support the instrument, thus restricting use of this hand during periods that the instrument is not being played and fatiguing the same hand. Further, these other supports allow rotation of the musical instrument about some axis, thereby limiting the extent to which the instrument is stabilized in a fixed position. These supports also do not orient the instruments in such a way as to facilitate easy playing of the instrument. The inventor has discovered the above-note problems and has developed solutions to these problems.

SUMMARY OF THE INVENTION

Accordingly, it is an object of the present invention to provide a musical instrument having a stabilization apparatus to maintain the musical instrument in a fixed position relative to the musician.

It is another of object of the present invention to provide a musical instrument having a stabilization apparatus which reduces fatigue on the musician in supporting the musical instrument.

It is yet another object of the present invention to provide a musical instrument having a stabilization apparatus which is adjustable in order to accommodate differences in the musician's size and preference as to the instrument's orientation relative to the ground.

It is still yet another object of the present invention to provide a musical instrument having a stabilization apparatus which allows the musician freedom of movement while both playing and not playing the musical instrument.

Additional objects and advantages of the invention will be set forth in part in the description which follows and, in part, will be obvious from the description, or may be learned by practice of the invention.

The foregoing objects of the present invention are achieved by providing a musical instrument which includes a stabilization apparatus for enabling the musical instrument to support itself on the musician, thereby allowing the musician complete freedom of movement. The musical instrument is braced against the musician's body at three specific points, thus providing stability that has not been available to musicians, and in particular, violinists and electric violinists.

The above objects are further achieved by an electric violin having an opening for receiving the neck of a musician, the opening being formed in the body which has a "V-shaped" wing design. This means that the body has a pair of wings which forms the opening for the neck of the musician. A first one of the wings has a curvature that fits snugly on a portion of the musician's neck, whereas the other wing has a tip which rests on the musician's chest. The first wing holds the instrument firmly in place and prevents it from moving to the side of the musician which includes the instrument. The other wing prevents the instrument from moving to the other side of the musician.

An adjustable telescopic mechanism is attached to the bottom of the instrument, at the portion of the neck which is adjacent to the body of the instrument and has a plate at one end to rest on the chest of the musician. The telescopic mechanism lengthens and shortens to enable the musician to customize the angle of the instrument on the musician's chest.

Further, an adjustable strap is fastened to one of the wings and is then placed across one shoulder, is swung down underneath an arm pit of the musician and is then fastened to the lower right side of the other wing.

BRIEF DESCRIPTION OF THE DRAWINGS

These and other objects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
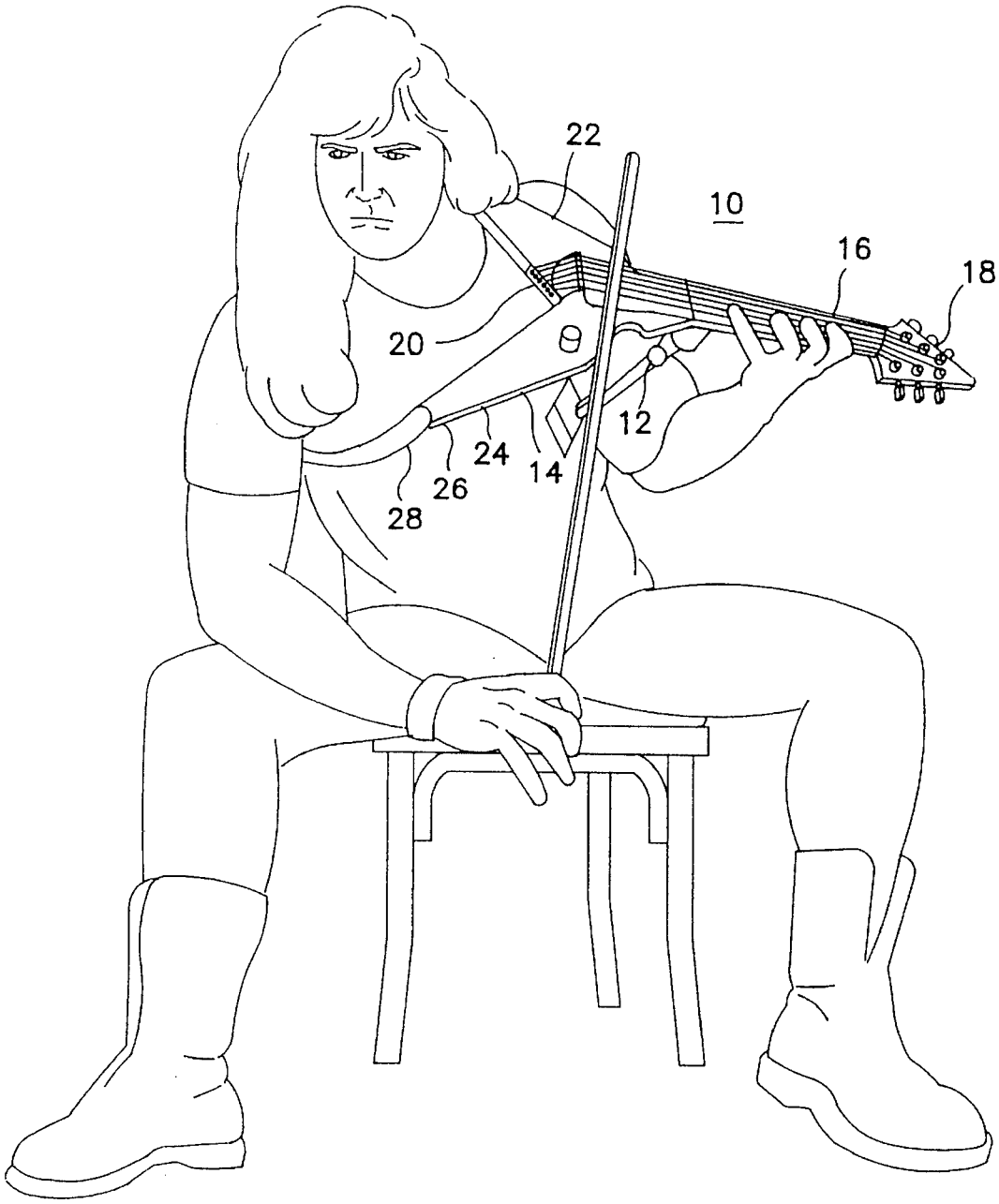
FIG. 1 is a from view of a musician playing an electric violin in accordance with an embodiment of the present invention.

Reference will now be made in detail to the present preferred embodiments of the present invention, examples of which are illustrated in the accompanying drawings, wherein like reference numerals refer to like elements throughout.

FIG. 1 is a front view showing a musician holding an electric violin having a stabilization apparatus according to an embodiment of the present invention. The electric violin 10 has an adjustable telescopic mechanism 12, adjustable support, which has one end affixed to the back of the electric violin 10 and another end which rests against the chest of the musician, a body 14 having a "V-shaped" configuration, a neck 16 connected to one end of the body 14 and a headstock 18 which adjusts the tension on and holds the strings of the electric violin 10.

The body 14 has an opening 20 through which the head and neck of the musician is placed. The opening 20 in the body 14 is formed by a first wing 22 (the top wing being partially viewable in FIG. 1) and a second wing 24 (the bottom wing in FIG. 1). The end of the first wing 22 fits snugly on the musician's neck and holds the electric violin 10 firmly in place and prevents it from moving in the direction to the right in FIG. 1. The second wing 24 is formed at an angle from the first wing 22 and a tip 26 of the second wing 24 rests on the opposite side (left side in FIG. 1 and right side of the musician's chest) of the musician's chest relative to the electric violin 10. This arrangement prevents the electric violin from moving in the direction of the left side of FIG. 1. An adjustable strap 28 is attached to the first wing 22 (not shown in FIG. 1, but shown in FIG. 2), and drapes around the neck of the musician and underneath the arm pit of the arm which does not hold the electric violin 10 but which holds a bow for the electric violin 10. The strap 28 is then fastened to the tip 26 of the second wing 24 and further stabilizes the position of the electric violin 10 relative to the musician by preventing the electric violin 10 from falling forward.

Figure 2:
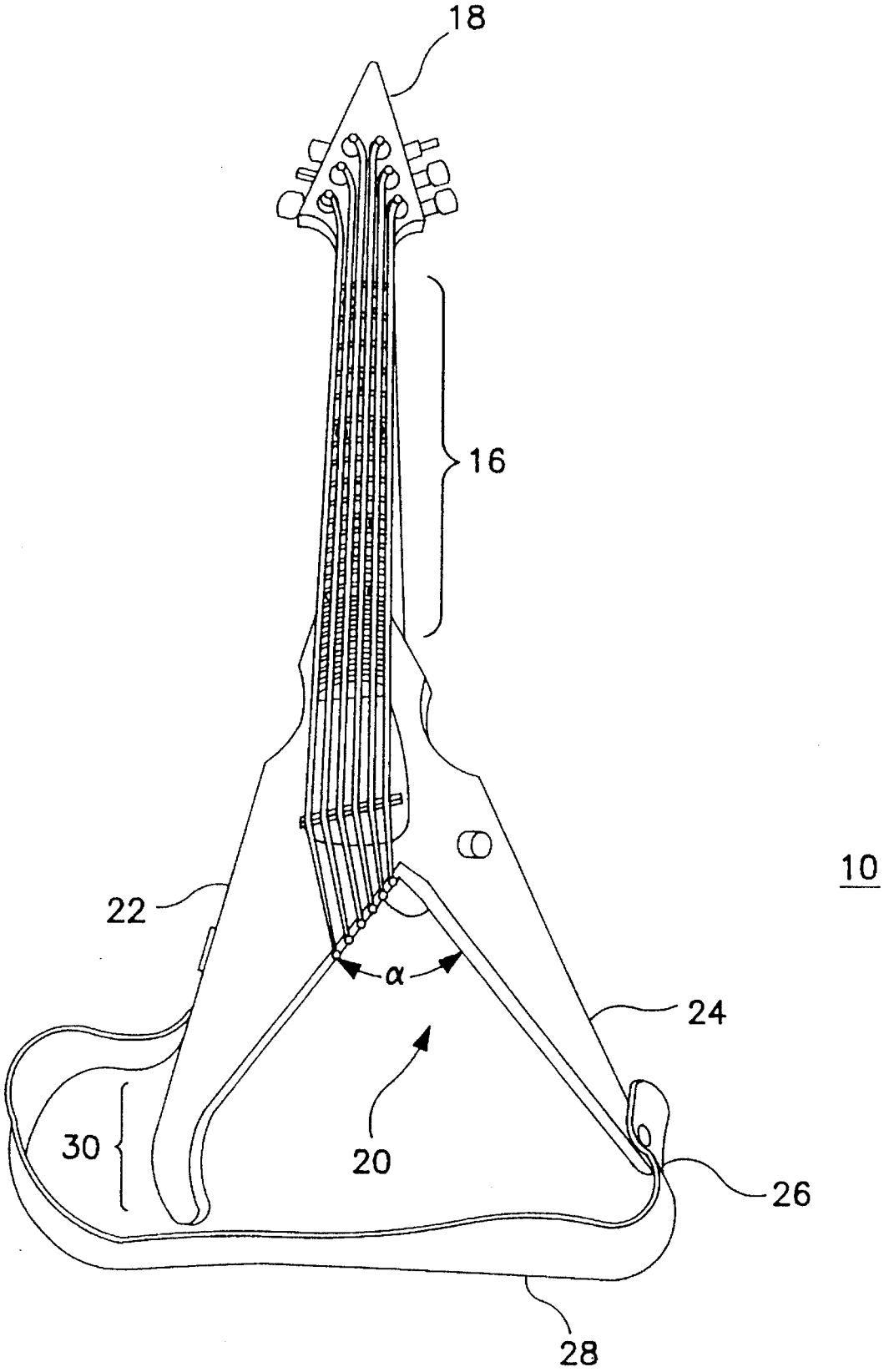
FIG. 2 is a top plan view of the electric violin according to the embodiment of the present invention.

FIG. 2 is a top plan view of the electric violin according to the embodiment of the present invention. The telescopic mechanism is underneath the electric violin 10 and can not be seen in this figure. FIG. 2 shows that the first wing 22 has a curvature 30 at its end opposite the neck 16 of the electric violin 10. The curvature 30 is the portion that fits snugly against the back of the musician's neck (as shown in FIG. 1). The curvature 30, by fitting snugly around the musician's neck, maintains the electric violin 10 firmly in place and prevents it from moving in the direction of the left side of the musician (the right side of FIG. 1). The inner portion of the second wing 24 is spaced apart from the inner portion of the first wing 22 by an angle $\alpha$, which is approximately 75° but may vary. As mentioned previously, the musician's head and neck fit in the opening 20, such that the curvature 30 of the first wing 22 rests on the back of the neck of the musician. The tip 26 of the second wing 24 rests on the side of the chest of the musician opposite the electric violin 10 to prevent the electric violin 10 from moving to the right side of the musician (the left side in FIG. 1). The strap 28, which prevents the electric violin from falling forward, is attached to the outside portion of the first wing 22 towards the end, and then the musician places his head and neck through the opening 20. After this is done, the strap 28, which extends across the back of the musician, is reachable by the musician and the musician swings the strap underneath the arm pit and fastens the strap 28 to the tip 26 of the second wing 24.

Figure 3:
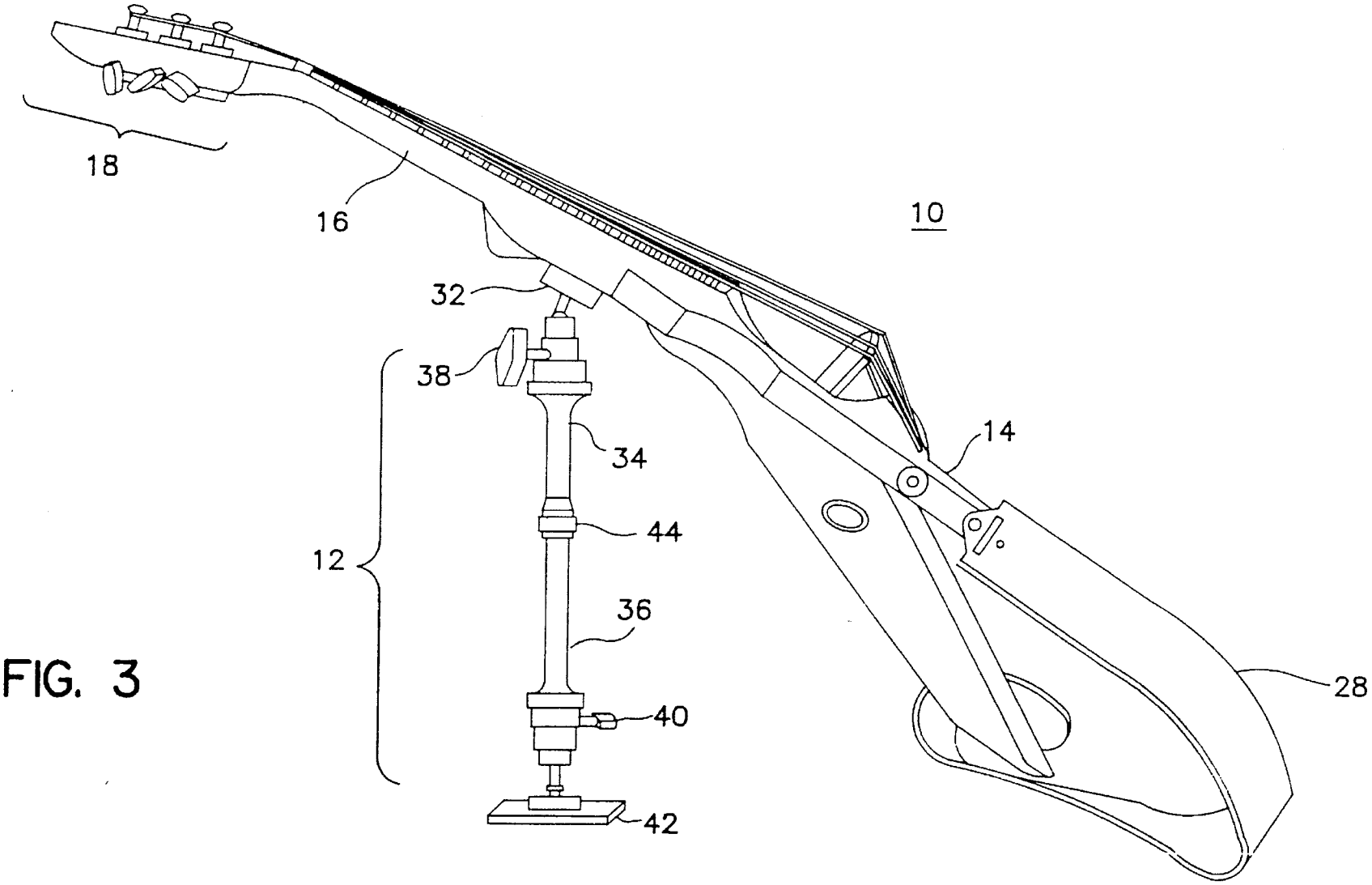
FIG. 3 is a side view of the electric violin shown in FIG. 1 with an adjustable telescopic mechanism.
Figure 4:
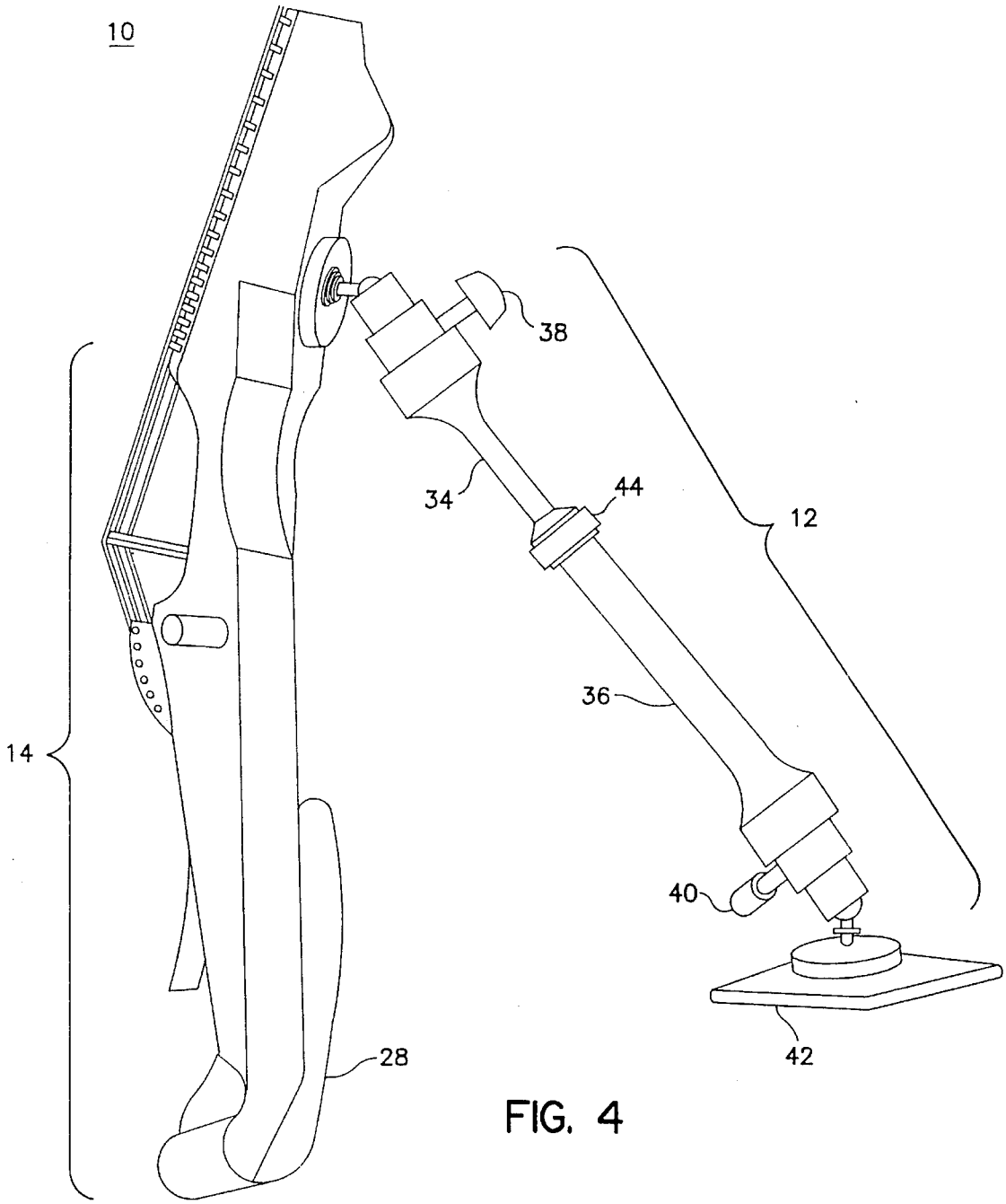
FIG. 4 is close-up side view of the electric violin shown with the telescopic mechanism shown in FIG. 3.

FIGS. 3 and 4 are a side view and a close-up side view, respectively, of the electric violin 10 with an adjustable telescopic mechanism 12 according to the embodiment of the present invention. A base plate 32 has a ball bearing extending from it and is screwed into the back of the body 14 of the electric violin 10. The ball bearing of the base plate 32 fits into a socket of a connector 34. A receptacle 36 receives the connector 34 and allows the connector 34 to slide in and out, thereby lengthening and shortening the telescopic mechanism 12. Knob 38 is rotatable relative to the connector 34 and loosens and tightens around the ball bearing of the base plate 32 to adjust and maintain the relative position of base plate 32 with respect to the connector 34. The knob 40 is rotatable relative to the receptacle 36. Plate 42 has a ball bearing extending from it which fits into a socket of the receptacle 36. The plate 42, therefore, is rotatable about the ball bearing extending from it and rests against the chest of the musician during use (as shown in FIG. 1). The knob 40 loosens and tightens around the ball bearing of the plate 42 to adjust and maintain the relative position of the plate 42 with respect to the receptacle 36. Ring 44 locks the position of the connector 34 relative to the receptacle 36 by being rotated in one direction and allows for movement of the connector 34 relative to the receptacle 36 when rotated in the opposite direction. By extending and shortening the telescopic mechanism 12, the stabilization apparatus is adaptable to musicians of different sizes. Further, the musician may lengthen or shorten the telescopic mechanism 12 to change the orientation of the electric violin 10 relative to the ground, so that the musician has easier access to applying the bow to the strings of the electric violin. Further, the ball bearings attached to the base plate 32 and plate 42 allow for the rotation of the connector 34 and receptacle 36 to conform with the configuration of the chest of the musician.

As is shown in FIG. 3, the telescopic mechanism 12 may also serve as an instrument stand for the electric violin 10. By adjusting the angle of the base plate 32 relative to the connector 34, the angle of the plate 42 relative to receptacle 36, and the total length of the connector 34 and the receptacle 36, the telescopic mechanism 12 is able to support the electric violin 10 such that only the plate 42 and the ends of the first and second wings 22, 24 touch the ground, thereby obviating the need for a separate instrument stand. By using the telescopic mechanism 12 as an instrument stand, the electric violin 10 does not lay on the ground and the musician is not required to carry around a separate detached instrument stand. Further, the costs are kept to a minimum as there is no need to purchase the separate detached instrument stand to support the electric violin 10 when the electric violin 10 is not in use.

Figure 5:
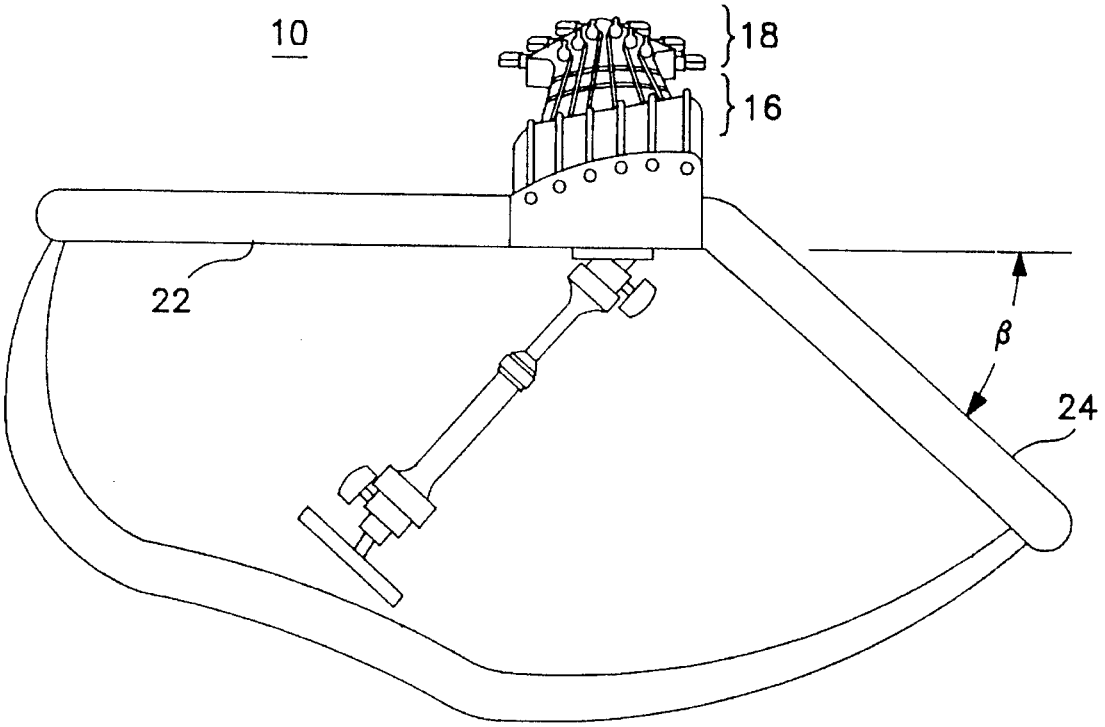
FIG. 5 is a from end view of the electric violin shown in FIG. 1.

FIG. 5 shows a front end view of the electric violin 10. The second wing 24 extends at an angle β from a plane formed by the first wing 22 and the neck 16. By slanting the second wing 24 at such an angle from the first wing 22 and the neck 16, the electric violin 10 is better supported at the side of the chest of the musician opposite the electric violin 10. Through experimentation, the inventor has determined that the angle β for providing the best support of the electric violin 10 and preventing the electric violin 10 from shifting to the side of the musician opposite the electric violin 10 is optimally 42°.

Although a preferred embodiment of the present invention has been shown and described, it would be appreciated by those skilled in the art that changes may be made in this embodiment without departing from the principles and spirit of the invention, the scope of which is defined in the claims and their equivalents.

I claim:

1. A musical stringed instrument having a neck, the musical stringed instrument comprising:

a body having an opening to receive a neck of a musician; and a support, attached at one end to a back of the musical stringed instrument, to support the musical stringed instrument by having the other end contact a chest of the musician.

2. The musical stringed instrument as claimed in claim 1, wherein:

said body has first and second wings which form the opening;

said first wing to rest on a back of a neck of the musician; and said second wing to contact the chest of the musician at a position different than the other end of the support.

3. The musical stringed instrument as claimed in claim 2, wherein said first wing has a curvature which conforms to the back of the neck of the musician to prevent movement of the musical stringed instrument.

4. The musical stringed instrument as claimed in claim 3, further comprising a strap attached at respective ends to said first and second wings.

5. The musical stringed instrument as claimed in claim 2, wherein the opening is V-shaped.

6. The musical stringed instrument as claimed in claim 2, further comprising a strap attached at respective ends to said first and second wings.

7. The musical stringed instrument as claimed in claim 2, wherein a plane of said second wing is oriented at an angle relative to a plane which includes said first wing and the neck of the musical stringed instrument.

8. The musical stringed instrument as claimed in claim 7, wherein said angle is approximately 42°.

9. The musical stringed instrument as claimed in claim 2, wherein the musical stringed instrument is an electric violin.

10. The musical stringed instrument as claimed in claim 2, wherein said support is attached to the back of the musical stringed instrument at a position approximately where the neck and body of the musical stringed instrument meet and is adjustable to support the musical stringed instrument at an inclined position relative to the ground, with ends of said first and second wings being two other points of support.

11. The musical stringed instrument as claimed in claim 1, wherein said support comprises an adjustable telescopic mechanism attached to said body and having an adjustable length.

12. The musical stringed instrument as claimed in claim 11, wherein said adjustable telescopic mechanism comprises:

length adjustment means for adjusting the length of said telescopic mechanism;

means for adjusting an orientation of said telescopic mechanism relative to said body and neck of the musical stringed instrument;

a plate, connected to said length adjustment means, to rest on the chest of the musician; and means for adjusting an orientation of said plate relative to said length adjustment means.

13. The musical stringed instrument as claimed in claim 11, wherein said adjustable telescopic mechanism comprises:

a base plate having a first ball bearing and attached to the back of the musical stringed instrument;

a connector encompassing the first ball bearing;

a first knob for tightening and loosening said connector about the first ball bearing;

a receptacle for receiving said connector;

a ring for allowing and ceasing movement of said connector relative to said receptacle;

a plate, having a second ball bearing, to rest on the chest of the musician, said receptacle encompassing the second ball bearing;

a second knob for tightening and loosening said receptacle about the second ball bearing.

14. The musical stringed instrument as claimed in claim 11, wherein a plane of said second wing is oriented at an angle relative to a plane which includes said first wing and the neck of the musical stringed instrument.

15. A musical stringed instrument played by a musician, the musical stringed instrument comprising:

a neck to support strings; and a body, connected at a side to the neck, to hold first ends of the strings, said body having two protrusions extending away from the strings to support the musical stringed instrument against the musician at first and second distinct points;

an adjustable support, attached to a back of the musical stringed instrument at a vicinity where said body and said neck are connected, to contact a torso of the musician at a third distinct point.

16. The musical stringed instrument as claimed in claim 15, wherein said body has first and second wings, with an opening formed between said first and second wings, with an inner portion of said first wing to contact a back of a neck of the musician at the first distinct point and an end of said second wing to contact the torso of the musician at the second distinct point.

17. The musical stringed instrument as claimed in claim 16, further comprising a strap, connected at respective ends to said first and second wings, said strap to be placed underneath an armpit of the musician.

18. The musical stringed instrument as claimed in claim 16, wherein the neck and said first wing are disposed in a first plane and said second wing is disposed in a second plane offset from said first plane by a predetermined angle in a direction of the back of the musical stringed instrument.

19. An electric stringed instrument to be played by a musician, the musical stringed instrument comprising:

a neck;

a body attached to said neck, wherein said body comprises first and second wings which form an opening, wherein an inner portion of said first wing is to rest on a back of a neck of the musician, and an end of said second wing is to rest on one side of a chest of the musician;

an adjustable telescopic mechanism attached at one end to the back of the electric stringed instrument, the other end of said adjustable telescopic mechanism to rest on the opposite side of the chest of the musician from the end of said second wing; and a strap connected at respective ends to said first and second wings.

20. The electric stringed instrument as claimed in claim 19, wherein:

said first wing has a curvature, with the back of the neck of the musician to fit within the curvature;

said second wing is disposed in a first plane offset from a second plane formed by said first wing and the neck of the electric stringed instrument by a predetermined angle;

said adjustable telescopic mechanism being adjustable in length and orientation relative to said body, and able to support the electric stringed instrument at an inclined angle relative to a rest base when the electric stringed instrument is separated from the musician.

21. A musical stringed instrument to be played by a musician, the musical stringed instrument comprising:

a neck having a first end to be supported by a hand of the musician, and a second end;

a body having a first end to be supported by a neck of the musician and a second end attached to the second end of said neck of the musical stringed instrument; and an adjustable telescopic mechanism attached at one end to the back of the body of the musical stringed instrument at a vicinity where said neck and body of the musical stringed instrument meet, the other end of said adjustable telescopic mechanism to rest on a torso of the musician.

22. A musical stringed instrument to be played by a musician, the musical stringed instrument comprising:

a neck; and a body attached to said neck, wherein said body comprises first and second wings which form an opening, wherein an inner portion of said first wing is to rest on a back of a neck of the musician, and an end of said second wing is to rest on one side of a chest of the musician.

23. A musical stringed instrument to be played by a musician, the musical stringed instrument comprising:

a neck;

a body attached to said neck, having an opening to receive a neck of the musician, wherein said body comprises first and second wings which form the opening, said first wing having a curvature to receive a back of the neck of the musician, said second wing to be slanted at a predetermined angle from a plane formed by said first wing and said neck of the musical stringed instrument, said second wing to rest on one side of a chest of the musician;

an adjustable telescopic mechanism attached at one end to the back of the musical stringed instrument, the other end of said adjustable telescopic mechanism to rest on the other side of the chest of the musician; and a strap connected to respective ends of said first and second wings.

* * * * *